10/27/81 XR 4,297,148

252/100

United States Patent [19]

Zervopoulos

[11] 4,297,148

[45] Oct. 27, 1981

[54] MASONRY CLEANING PROCESS AND COMPOSITION

[76] Inventor: Panagiotis Zervopoulos, 514 Pape Ave., Toronto, Canada, M4K 3R2

[21] Appl. No.: 139,942

[22] Filed: Apr. 14, 1980

[30] Foreign Application Priority Data

Apr. 17, 1979 [CA] Canada ..... 325783

[51] Int. Cl.[3] ..... B08B 3/08

[52] U.S. Cl. ..... 134/3; 134/28; 252/100; 252/142

[58] Field of Search ..... 134/3, 28; 252/100, 252/142, 79.3

[56] References Cited

U.S. PATENT DOCUMENTS

| | | | |
|---|---|---|---|
| 2,172,041 | 9/1939 | Urban | 252/100 |
| 3,063,875 | 11/1962 | Barry | 134/28 |
| 3,150,007 | 9/1964 | Kovachy | 134/28 X |
| 3,239,440 | 3/1966 | Covington | 252/79.3 X |
| 3,843,430 | 10/1974 | Kinder | 252/79.3 X |

FOREIGN PATENT DOCUMENTS

| | | | |
|---|---|---|---|
| 8124 | of 1885 | United Kingdom | 252/142 |

*Primary Examiner*—Marc L. Caroff

*Attorney, Agent, or Firm*—Arne I. Fors; Robert F. Delbridge

[57] ABSTRACT

An aqueous composition for cleaning masonry containing sulphuric acid, hydrofluoric acid, chromic acid and a water miscible wetting agent.

5 Claims, No Drawings

MASONRY CLEANING PROCESS AND COMPOSITION

BACKGROUND OF THE INVENTION

This invention relates to a method and composition for cleaning surfaces such as the exterior brick and stone walls of buildings coated with grime by airborne gaseous and solid pollutants common in industrialized centres.

It is known to clean masonry surfaces by sand blasting and by high pressure water jets. However, the former is expensive, creates pollution, damages the texture of the surface to be cleaned and may damage glass window panes, while the latter often is not effective in removing many years' accumulation of deposits. Aqueous solutions of alkaline and acid substances are known, as typified in U.S. Pat. Nos. 2,837,484; 3,523,825; 3,681,141 and 3,379,645, but known solutions generally have not been effective in removing surface deposits, have been excessively corrosive of the underlying brick or stone, or have been hazardous to use.

SUMMARY OF THE INVENTION

The solution of my invention comprises, in general, a composition suitable for cleaning masonry which comprises, by weight: about 8 to 30% sulphuric acid of 66 degrees Baumé concentration; about 23 to 30% hydrogen fluoride or 70% concentration; about 0.1 to 0.2% chromic acid; about 0.9 to 1.8% wetting agent, and the balance water.

It is a principal object of the present invention to provide a method and a cleaning composition which permits effective removal of coatings of grime and the like deposits on exterior masonry surfaces while being relatively safe for industrial, commercial or domestic use. Another object of the invention is the provision of a method and a composition which does not unduly attack and corrode the masonry surface being cleaned.

Other objects of the invention and the manner in which they can be attained will become apparent from the following detailed description of the method and composition of the invention.

DESCRIPTION OF THE PREFERRED EMBODIMENTS

The composition of my invention consists essentially of an aqueous mixed solution having the following composition, by weight:

| | Percent |
|---|---|
| Sulphuric acid | 8–29 |
| Hydrofluoric acid | 23–30 |
| Chromic acid | 0.1–0.2 |
| Wetting agent | 0.9–1.8 |
| Water | 68–39 |

A preferred composition consists essentially of the following, percentages again being expressed on a weight basis:

| | Percent |
|---|---|
| Sulphuric acid | 27 |
| Hydrofluoric acid | 29 |
| Chromic acid | 0.2 |
| Wetting agent | 1.5 |

-continued

| | Percent |
|---|---|
| Water | 42.7 |

The composition is prepared by adding the sulphuric acid to water and then adding hydrofluoric acid to the dilute sulphuric acid solution. Wetting agent is then added followed by chromic acid added by dissolving the chromic acid in the dilute solution.

In the above composition, the term "sulphuric acid" refers to electrolyte grade 66 degree Baumé acid, containing 93.2% sulphuric acid. The term "hydrofluoric acid" refers to hydrogen fluoride in aqueous solution, containing 70% concentration. Hydrofluoric acid can be formed by the addition of anhydrous hydrogen fluoride to water.

The term "chromic acid" refers to high purity grade chromic acid flakes of 99.9% chromic acid content.

Acids of other strengths can be utilized in the composition, it being understood that their proportions must be adjusted accordingly.

The wetting agent is a water soluble surface active agent of the class represented by, for example, STERLING F-621-D (Trade Mark), a water miscible nonionic surfactant. The method of applying my composition for cleaning surfaces for removal of stains, deposits and films therefrom may be illustrated by the following example.

EXAMPLE

A solution of the concentrated preferred composition shown above containing by weight 27% sulphuric acid, 29% hydrofluoric acid, 0.2% chromic acid, 1.5% wetting agent, and the balance (42.7%) water at ambient temperature was sprayed onto a brick surface covered by a coating of grime from exposure to an industrial environment. The composition was permitted to remain on the surface for 10 minutes and then the surface sprayed with water under high pressure which readily removed the coating from the surface.

The composition can be used for cleaning sandstone, slate and clay brick surfaces in a concentrated form as described above within the broad range recited or diluted by the addition of up to 6 parts of water to 1 part of the concentrated composition. A lower limit of about 8% by weight sulphuric acid is preferred for cleaning limestone and marble surfaces. Surfaces of coarse aggregates often can be cleaned with solutions diluted about 5:1 or 6:1 and surfaces of old clay brick cleaned with solutions diluted about 2:1 or 3:1. The composition in its concentrated or diluted form may be applied to the masonry surface to be cleaned by spraying, brushing or rolling of the composition onto the surface.

The time required for contact of the composition on the surface treated will vary depending on the nature and thickness of the deposit and on the concentration of the composition. At ambient temperatures of about 21° C., a contact period of from about 1 to about 15 minutes is usually ample for loosening surface deposits. It is important that the composition be washed from the surface at the end of a desired treatment period to avoid formation and deposition of undesired salts. It will be understood that the above Example is illustrative of the method and composition of the invention and not limitative of the scope thereof.

What I claim as new and desire to protect by Letters Patent of the United States is:

1. A cleaning composition suitable for cleaning masonry which comprises, by weight, about 8 to 30% sulphuric acid; about 23 to 30% hydrogen fluoride; about 0.1 to 0.2% chromic acid; about 0.9 to 1.8% water miscible wetting agent, and water in such amount to constitute the remainder of the composition.

2. A cleaning composition as claimed in claim 1 which contains, by weight, about 27% sulphuric acid and about 29% hydrogen fluoride.

3. A cleaning composition as claimed in claim 1 or 2 diluted with up to 6 parts of water to 1 part of composition.

4. A method of cleaning masonry surfaces comprising: applying to said surface, for a predetermined time sufficient to loosen deposits therefrom, a composition comprising, by weight, about 8 to 30% sulphuric acid; about 23 to 30% hydrogen fluoride; about 0.1 to 0.2% chromic acid; about 0.9 to 1.8% water miscible wetting agent, and the balance water, and then washing said surface with water.

5. A method as claimed in claim 4, in which said composition contains, by weight, 27% sulphuric acid and 29% hydrogen fluoride.

* * * * *